United States Patent [19]

Christen, Jr. et al.

[11] 3,964,373

[45] June 22, 1976

[54] PAPER LOG ROLLER

[75] Inventors: Louis J. Christen, Jr.; John J. Latal, both of St. Louis, Mo.

[73] Assignee: Christen Incorporated, St. Louis, Mo.

[22] Filed: Mar. 19, 1975

[21] Appl. No.: 559,753

[52] U.S. Cl. ..... 93/1 C; 93/81 R; 242/67.1 R

[51] Int. Cl.[2] ..... B31C 1/00

[58] Field of Search ..... 44/2; 93/1 C, 81 R, 93/77 R; 156/446; 242/60, 67.1 R

[56] References Cited

UNITED STATES PATENTS

| | | | |
|---|---|---|---|
| 238,457 | 3/1881 | Tillmes | 93/81 R |
| 649,694 | 5/1900 | Hunter | 242/67.1 R |
| 2,243,667 | 5/1941 | Busa | 242/67.1 R |
| 3,033,481 | 5/1962 | Wolk | 242/67.1 R |
| 3,186,443 | 6/1965 | Budzyna | 242/67.1 R X |

OTHER PUBLICATIONS

Logger Industries Order Form, 1972.

*Primary Examiner*—James F. Coan

*Attorney, Agent, or Firm*—Ralph W. Kalish

[57] ABSTRACT

A device for forming a log-simulative member from combustible, flexible sheet material comprising spaced-apart end frames, having an upwardly opening pan extending between and supported by said end frames and being of semi-annular cross section. A shaft extending between said end frames in elevated relationship to the base of said pan and being adapted for rotation as well as endwise withdrawal from said device. Leaf springs are mounted within said pan for applying upwardly directed force upon said material wound about said shaft as the same is developed into a log-simulative member.

6 Claims, 7 Drawing Figures

PAPER LOG ROLLER

BACKGROUND AND SUMMARY OF THE INVENTION

This invention relates in general to articles of combustion and, more particularly, to a hand-operated devicce for making logs from combustible sheet material.

Heretofore, with increased cost of wood as a source of combustion, primarily for home usage, as within fire places and stoves, considerable attention has been directed to the utilization of paper and like sheet material as a substitute. Various efforts have been made to compact paper into a unitary body to provide relatively long term burning as distinguished from the usual quick, flash-like flaming when sheets are burned. Such efforts have included trials at developing a discrete log-simulative member from a multiplicity of paper sheets. But such attempts have met with indifferent success as the problem of forming such members, as well as retaining same in formed state for any appreciable length of time has proved extremely difficult and unsatisfactory.

Therefore, it is an object of the present invention to provide a hand-operated device for developing combustible discrete bodies of log-shape from sheet material, which bodies will retain their formation for indefinite periods of time and, hence, be amenable to storage pending usage.

It is a further object of the present invention to provide a device of the character stated for producing a log from combustible sheet material when the said components are interwound in a coil condition appropriate to provide desired slow-burning, yet capable of high heat productivity.

It is a still further object of the present invention to provide a device of the character stated which is uniquely designed for home usage so that the average unskilled individual may readily, and without undue exertion, effect the formations of such combustible log-simulative member; thereby obviating the need for skilled assistance as well as eliminating the requirement for purchasing costly wooden logs.

It is another object of the present invention to provide a device of the character stated which is economically made from a limited number of durable, wear-resistant components; which device is relatively lightweight and, hence, provides no barriers to ease of transportability; and which is highly reliable and durable in usage.

DESCRIPTION OF THE PREFERRED EMBODIMENT

Figure 1:
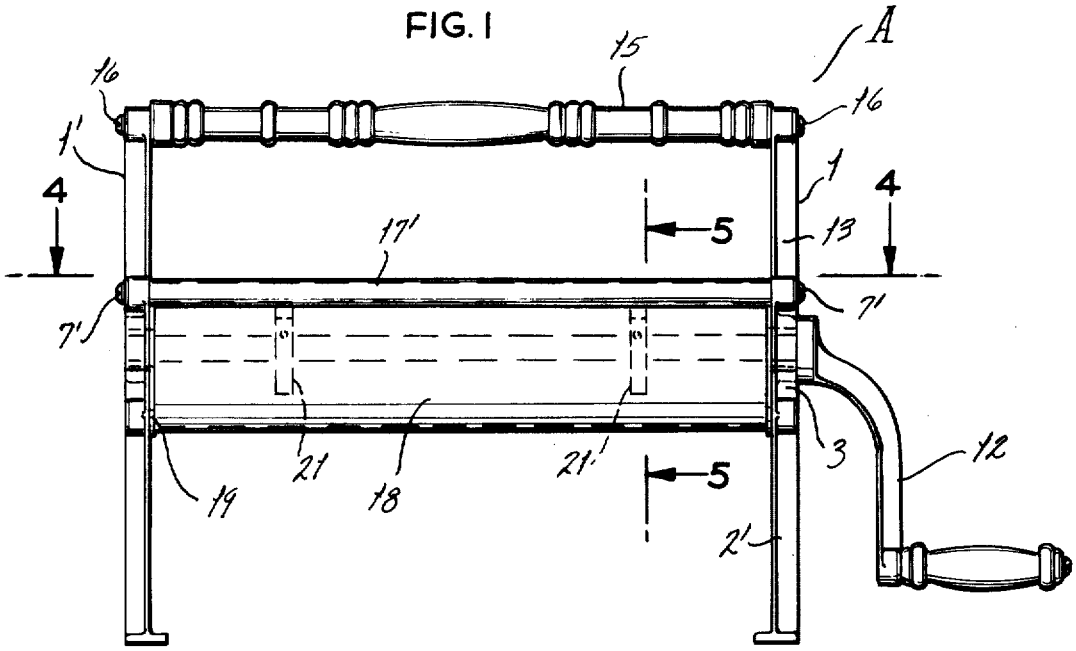
FIG. 1 is a front elevational view of a paper log roller constructed in accordance with and embodying the present invention.
Figure 2:
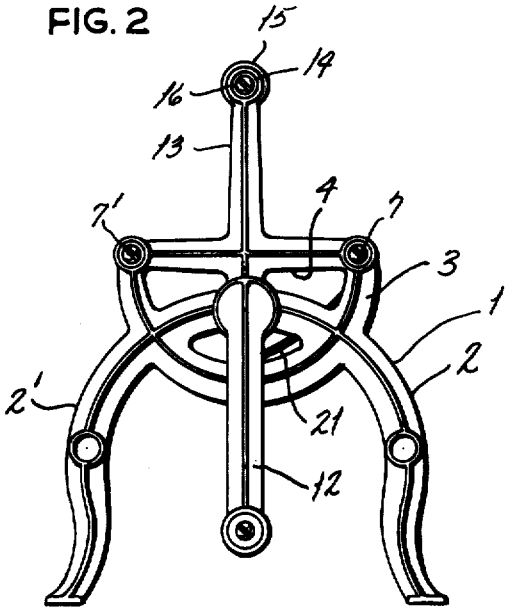
FIG. 2 is an end elevational view taken from the right hand side of FIG. 1.
Figure 3:
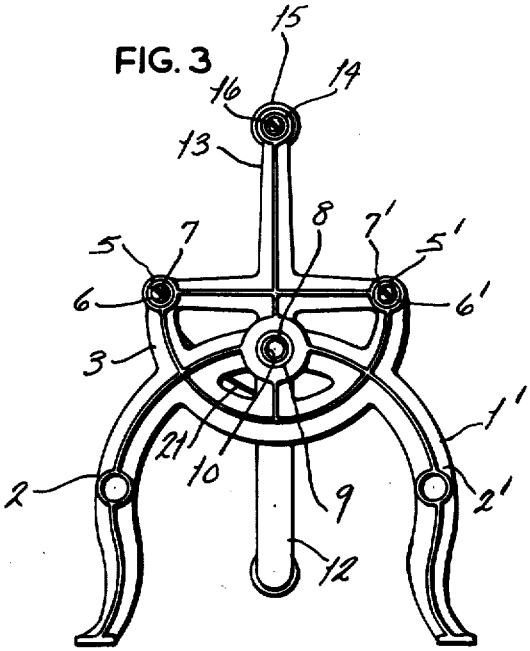
FIG. 3 is an end elevational view taken from the left hand side of FIG. 1.
Figure 4:
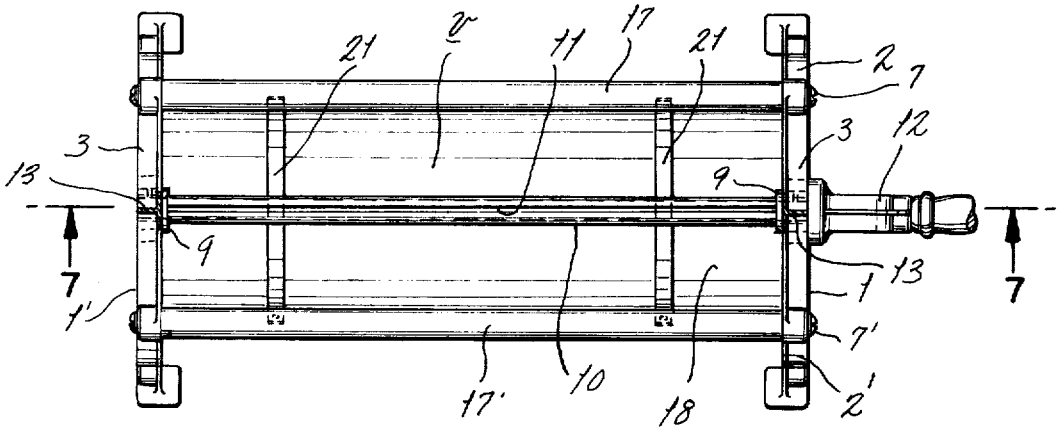
FIG. 4 is a horizontal transverse sectional view taken on the line 4—4 of FIG. 1.

Referring now by reference characters to the drawings which illustrate the preferred embodiment of the present invention, A generally designates a roller for use in the development of log-shaped or log-simulative members from combustible sheet material, such as, particularly paper, as exemplified by newspaper. Said roller A comprises a pair of longitudinally spaced apart end frames 1,1' which may, if desired, be unitary castings, each of which includes a pair of legs or standards 2,2' for supporting roller A upon a convenient surface such as the floor, a table, or bench, or the like. Each and frame 1,1' in its upper central portion is provided with a wall section 3 which is of generally semi-annular configuration and preferably being perforated, as at 4, for weight-reduction, as well as for aesthetic or appearance purposes. The upper end portion of each wall section 3 is generally rectilinear having at its opposite ends a pair of openings 5,5' in alignment with corresponding openings in the other end frame for accepting the end portions of rods 6,6' each of which latter is internally tapped at its ends for engagement therein of retaining screws 7,7' to thereby rigidly interconnect end frames 1,1' into a sturdy structure.

Substantially centrally of the related wall section 3, each end frame 1,1' includes a bearing 8 for journaling therein of relatively enlarged collars 9 mounted, as by set screws, on the ends of a shaft 10, which latter thus extends between frames 1,1' and is provided with a co-extensive radially outwardly opening slot-like recess 11 of a width and depth for snugly accepting the end edge portions of a plurality of superimposed sheets of combustible material, such as, a newspaper or a section thereof. Shaft 10 projects beyond and frame 1 and its proximate coller 9 for affixation to the upper portion of a crank arm or so-called handle 12, the turning of which brings about the rotatin of shaft 10 for sheet winding thereabout to be described hereinbelow.

Figure 7:
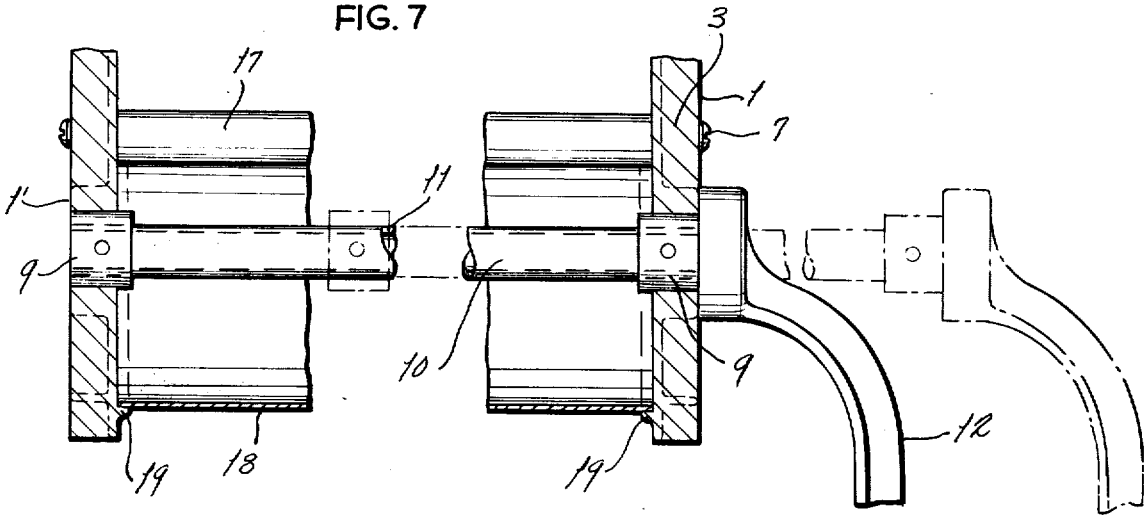
FIG. 7 is a vertical transverse sectional view taken on the line 7—7 of FIG. 5.

With particular reference to FIG. 7 it is to be observed that shaft 10 is freely shiftable longitudinally of roller A relative to end frame 1 so as to be freely removable from the bearings 8 within said end frames 1,1' for withdrawal from a log-simulative member formed thereon. Thus, the user need merely pull endwise upon handle 12 for effecting complete disengagement of shaft 10 from roller A.

Projectng upwardly from each end frame 1,1', as in vertical alignment with its proximate bearing 8, is an arm 13 provided with an opening 14 at its upper end for accepting one end of a gripping member or handle 15 extending between said arms 13 and being internally tapped at its opposite ends for securement within said opening 14 by screws 16 to stabilize said handle 15 in firm position whereby the same presents a convenient grip for transporting roller A. Handle 15 may, if desired, be fabricated from wood having its exterior ornamented as through a turning operation.

Each of said rods 6,6' extends though a sleeve portion 17,17', respectively, integrally formed from the opposite lateral edge portions of a pan 18 fabricated from relatively rigid sheet material, such as metal or plastic, and being transversely arcuated into semi-annular formation for conforming with the angle of curvature of wall sections 3 of end frames 1,1'. Said pan 18 is open upwardly and normally opens at its ends with the edge portions of the latter disposed upon a flange 19 integrally cast with each wall section 3 of end frames 1,1' on the inner surfaces thereof whereby said pan 18 is maintained against horizontal or endwise displacement. The rigidity of pan 18 is, of course, assured also by reason of the suspension of sleeves 17,17' upon rods 6,6'. Thus, pan 18 cooperates with end frames 1,1' to define a volume *v* for receiving the work, with the length of said volume *v* being commensurate with the length of the log-simulative member to be formed.

Figure 5:
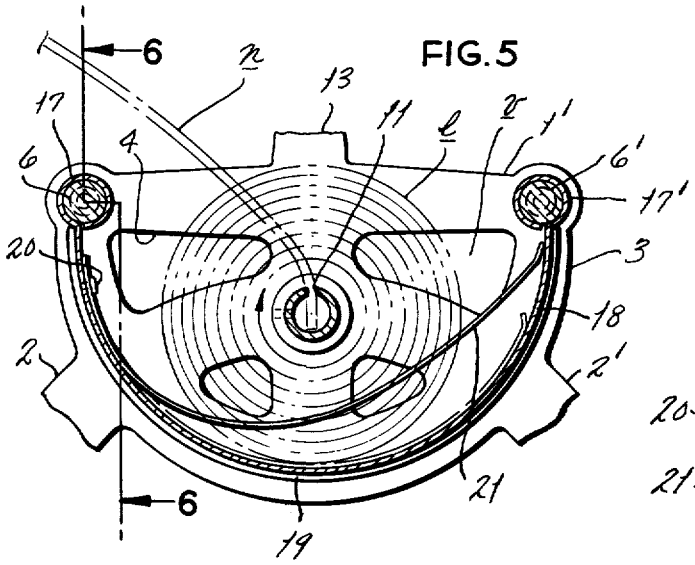
FIG. 5 is a vertical transverse sectional view taken on the line 5—5 of FIG. 1 and illustrating, in phantom lines, a newspaper fed to the device, as well as a formed log.
Figure 6:
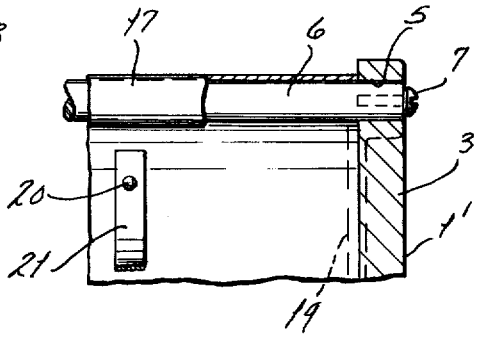
FIG. 6 is a fragmentary vertical sectional view taken on the line 6—6 of FIG. 5.

Secured as by rivets 20, upon the inner side face of pan 18, and at spaced points thoughout its length; (there being shown two such locations in the Figures) and immediately downwardly of sleeve 17, are one of the ends of flat leaf springs 21 which continue across the volume *v* beneath shaft 10, and with their opposite or free ends terminating normally just below sleeve 17' (see FIG. 5). The inherent bias of springs 21 will tend to cause them to be urged upwardly away from the base of pan 18 and with their central portion being thus prejudiced toward shaft 10 and the work being wound thereon.

In operation, with shaft 10 so disposed as to preferably present recess 11 upwardly for convenient insertion therein of the edge portion of sheet material to contribute to a log to be formed, such as for instance, the edge portions of a section of a newspaper which is indicated in phantom lines at *n*. Upon such insertion, the operator then turns crank arm 12 in a clockwise manner, as indicated by the arrow in FIG. 5, to cause the sheet material to be wound about shaft 10 with the developing coil being rendered tight by virtue of the force of springs 21 acting thereagainst, as stress is developed through enlargement of the coil with the urging of the springs 21 against their normal bias. After the particular sheet material or newspaper *n* has been thus initially wound about shaft 10, the operator then merely applies the edge section of a succeeding sheet or newspaper section along the now formed coil and holds same thereagainst with one hand while turning crank arm 12 resulting in such succeeding component thus being brought into snugly wound state about the first portion so wound and with springs 21 constantly applying a force conducive to close winding as the diameter of the member being formed increases, and causes increased stress of said springs 21. Accordingly, the operation may be continued with additional sheet material being coiled or wrapped about the previously wound section until an ultimate cylindrical or log-simulative body is developed having a cross-section or diameter commensurate with that of volume *v* of pan 18. Thereupon, shaft 10 is withdrawn by an outward pulling, endwise of roller A upon crank arm 12 which will thus effect disengagement between said shaft 10 and the edge portion of the first or initial wrapped component, as recess 11 is open at its ends, thereby leaving the formed log member, as indicated at *l* in phantom lines in FIG. 5, for withdrawal from pan 18 for immediate combustion or storage, as desired.

In view of the foregoing it is apparent that roller A is especially suited for home usage; not requiring any unique or developed skills on the part of the user for operation; and which reliably brings about the production of log-simulative members as formulated of flexible, combustible sheet material, and with such resultant member being tightly wound so as to be form-retentive as by having high physical integrity, for storage intervals, as well as being productive of reliable, slow burning, high heat capacity.

We claim:

1. A device for making log-simulative members from flexible sheet material comprising spaced apart first and second end frames, said frames having aligned bearings, a shaft journaled in said end frame bearings for rotation therein and extending between said end frames, means for effecting rotation of said shaft, means for detachably engaging an end portion of the flexible sheet material to said shaft whereby upon rotation of said shaft said sheet material will be wound thereabout, a pan-forming member mounted upon said end frames and extending therebetween for disposition beneath said shaft and for cooperating with said end frames to define a volume for receiving the log-simulative member during formation, elongated leaf springs provided within said pan-forming member and having one end affixed to one side portion of said pan-forming member and with their other ends being free and normally disposed adjacent the opposite side portion of said pan-forming member, said leaf springs extending beneath said shaft for bearing against the log-simulative member during formation for urging the material into tightly wound condition about said shaft.

2. A device for making log-simulative members as defined in claim 1 and further characterized by said means for rotating said shaft comprising a crank arm engaged upon one end of said shaft beyond one of said end frames.

3. A device for making log-simulative members as defined in claim 1 and further characterized by said shaft being slidingly mounted within said bearings for endwise removal of said shaft from said device subsequent to formation of the log-simulative member.

4. A device for making log-simulative members as defined in claim 1 and further characterized by said means detachably engaging said flexible sheet material to said shaft comprising a slot-like recess formed in said shaft and coextensive therewith, said recess having a cross section commensurate with the thickness of the received end portion of the said material, said recess being opened at its ends for facilitating withdrawal of said shaft from said material after log-simulative formation.

5. A device for making log-simulative members as defined in claim 1 and further characterized by said pan-forming member being of arcuate cross section and formed on a radius commensurate with that of the log-simulative member to be formed.

6. A device for making log-simulative members as defined in claim 4 and further characterized by means defining a carrying handle provided spacedly upwardly of said shaft.

* * * * *